US008181673B2

(12) United States Patent
Rigby et al.

(10) Patent No.: US 8,181,673 B2
(45) Date of Patent: May 22, 2012

(54) WOVEN FABRIC BAND FOR CIRCULATION IN A MACHINE

(75) Inventors: Alister John Rigby, Lancashire (GB); Rex Barrett, Neenah, WI (US)

(73) Assignee: Heimbach GmbH & Co. KG, Duren (DE)

( * ) Notice: Subject to any disclaimer, the term of this patent is extended or adjusted under 35 U.S.C. 154(b) by 243 days.

(21) Appl. No.: 12/728,411

(22) Filed: Mar. 22, 2010

(65) Prior Publication Data

US 2010/0236742 A1 Sep. 23, 2010

(30) Foreign Application Priority Data

Mar. 20, 2009 (EP) ..... 09004017

(51) Int. Cl.
*D03D 3/04* (2006.01)
*D21F 7/08* (2006.01)
*D03D 25/00* (2006.01)

(52) U.S. Cl. ..... 139/383 A; 139/383 R; 139/383 AA; 139/420 A; 162/358.2

(58) Field of Classification Search ..... 162/358.2; 139/383 R, 383 A, 383 AA, 420 A
See application file for complete search history.

(56) References Cited

U.S. PATENT DOCUMENTS

| | | | | | |
|---|---|---|---|---|---|
| 4,815,503 | A * | 3/1989 | Borel | 139/383 A |
| 4,928,737 | A * | 5/1990 | Borel | 139/383 A |
| 4,989,648 | A * | 2/1991 | Tate et al. | 139/383 A |
| 5,016,678 | A * | 5/1991 | Borel et al. | 139/383 A |
| 5,169,711 | A | 12/1992 | Bhatt et al. | |
| 5,490,543 | A * | 2/1996 | Fujisawa | 139/383 A |
| 5,558,926 | A * | 9/1996 | Tate et al. | 428/193 |
| 5,829,489 | A * | 11/1998 | Kuji | 139/383 A |
| 6,155,308 | A * | 12/2000 | Kuji | 139/410 |
| 6,533,901 | B2 * | 3/2003 | Taipale | 162/348 |
| 7,270,151 | B2 * | 9/2007 | Nagura et al. | 139/383 A |
| 7,585,394 | B2 | 9/2009 | Heger et al. | |
| 2004/0094223 | A1 * | 5/2004 | Johnson et al. | 139/383 A |
| 2006/0162804 | A1 * | 7/2006 | Heger et al. | 139/383 A |
| 2007/0209770 | A1 * | 9/2007 | Barrett et al. | 162/358.2 |
| 2008/0035230 | A1 * | 2/2008 | Danby et al. | 139/383 A |
| 2009/0139679 | A1 * | 6/2009 | Howarth et al. | 162/289 |
| 2010/0236742 | A1 * | 9/2010 | Rigby et al. | 162/289 |

FOREIGN PATENT DOCUMENTS

| | | |
|---|---|---|
| DE | 10 2004 016 640 B3 | 8/2005 |
| EP | 1 025 306 B1 | 4/2003 |
| GB | 1 562 284 | 3/1980 |
| WO | WO 2006/020414 A1 | 2/2006 |

* cited by examiner

*Primary Examiner* — Bobby Muromoto, Jr.
(74) *Attorney, Agent, or Firm* — Berenato & White, LLC

(57) ABSTRACT

A woven fabric band having a first and a second woven fabric layer having second longitudinal and second transverse threads, the outer side of the second woven fabric layer being formed by floats of longitudinal threads, wherein the longitudinal threads form a first longitudinal thread group with outer longitudinal threads and a second longitudinal thread group with inner longitudinal threads and that the outer longitudinal threads form the outer side of the second layer and the inner longitudinal threads extend within the band.

20 Claims, 4 Drawing Sheets

WOVEN FABRIC BAND FOR CIRCULATION IN A MACHINE

CROSS-REFERENCE TO RELATED APPLICATIONS AND CLAIM TO PRIORITY

Figure 1:
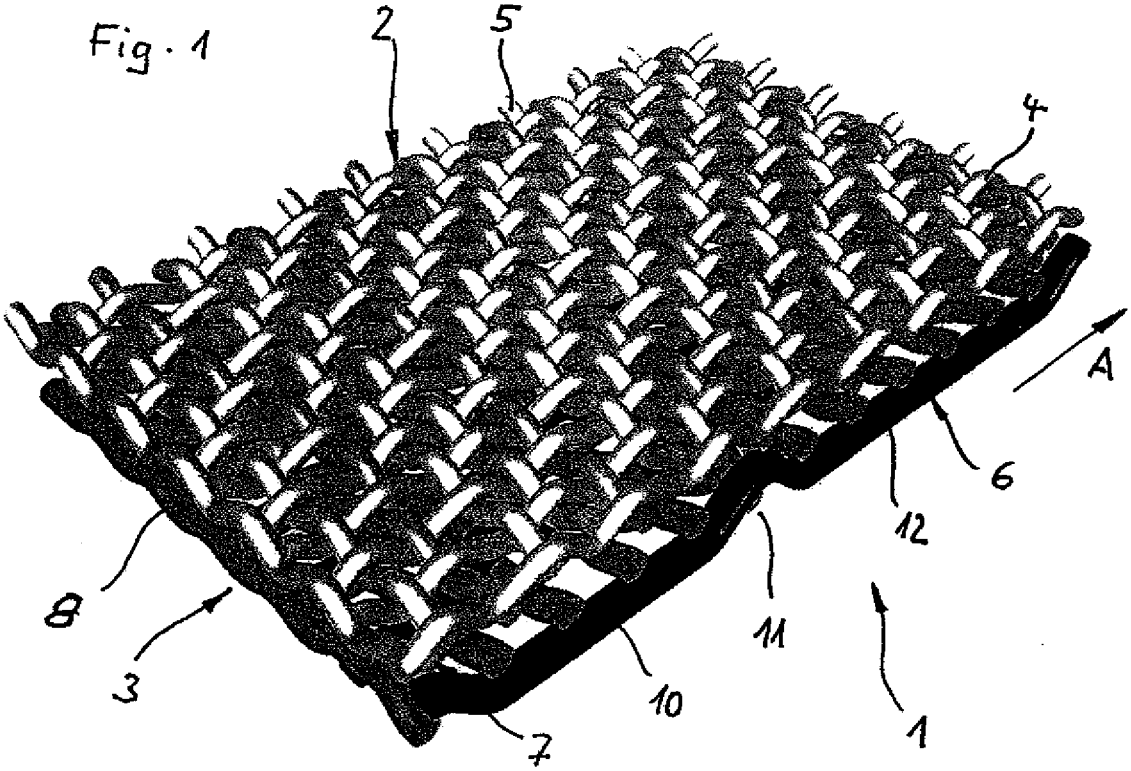

This application is related to application number 09 004 017.1, filed Mar. 20, 2009 in the European Patent Office, the disclosure of which is incorporated by reference and to which priority is claimed.

FIELD OF THE INVENTION

The invention relates to a woven fabric band for circulation in a machine, in particular a paper machine woven fabric band, and above all here a forming fabric, having a first woven fabric layer comprising first longitudinal and first transverse threads interwoven with one another and having a second woven fabric layer comprising second longitudinal and second transverse threads interwoven with one another, the outer side of the second woven fabric layer being formed by floats of second longitudinal threads.

BACKGROUND OF THE INVENTION

A paper machine woven fabric band of this type is disclosed in WO 2006/020414 A1. It has two woven fabric layers disposed one over the other, the first woven fabric layer or the one on the paper side being formed by first transverse threads and first longitudinal threads, and the second woven fabric layer or the one on the machine side being formed by second transverse and second longitudinal threads. The first longitudinal threads bind a transverse thread of the second woven fabric layer within a repeat and in this way join the two woven fabric layers. The second longitudinal threads only bind within the lower woven fabric layer by floating on the lower side over a plurality of second transverse threads and at the binding points binding just one second transverse thread respectively on the inside. The floats form the outer side of the second woven fabric layer and in this way improve the abrasion resistance. Here some of the longitudinal threads should be made of polyamide or polyester.

A disadvantage with this paper machine woven fabric band is that the second longitudinal threads must absorb a large part of the tensile forces acting upon the woven fabric band in the paper machine and that the cross-section of these second longitudinal threads and so the tensile strength of the latter decreases due to abrasion as the operating time increases.

In GB 1 562 284 a single-layer paper machine woven fabric band is disclosed wherein, as regards their material, the longitudinal threads comprise two groups, namely a first longitudinal thread group which first and foremost should guarantee the dimensional stability of the band and for which polyester is proposed as a material, and a second longitudinal thread group which is characterized by greater abrasion resistance in relation to the longitudinal threads of the first group, and are therefore produced, for example, from polyamide. It is proposed here to allow the longitudinal threads to extend in two layers, the polyester threads in the layer on the paper side and the polyamide threads in the layer on the machine side.

In EP 1 025 306 B1 a single-layer paper machine woven fabric band is disclosed the structure of which comprises interconnected longitudinal and transverse threads, longitudinal threads additionally being woven in as reinforcement threads with floats extending on the lower side of the band, said threads improving abrasion resistance and reducing friction with respect to the machine parts and so the expenditure of energy when circulating in the paper machine. These longitudinal threads can be made, for example, of polyamide, while the other longitudinal threads and also the transverse threads are made of polyester or polyethylene naphthalate.

Single-layer paper machine woven fabric bands offer the advantage that they are lower in weight and are less stiff than two- or three-layer woven fabric bands, and so are easier to install in the paper machine (see EP 1 025 306 B1, section [0020]), but have the disadvantage that the paper side is not formed independently of the machine side and so an optimal woven fabric structure can not be achieved.

In DE 10 2004 016 640 B3 a paper machine woven fabric band is disclosed, which has two woven fabric layers disposed one over the other. The first woven fabric layer destinated to be the paper side layer is formed by first transverse threads and first longitudinal threads, and the second woven fabric layer destinated to be the machine side layer is formed by second transverse and second longitudinal threads. Both woven fabric layers are joined by separate and additional binder yarns extending transversely and binding a longitudinal thread of the first woven fabric layer and then a second longitudinal thread of the second woven fabric layer one after another. In the description it is suggested that binder yarns can also be provided as machine direction yarns without disclosing, how they are bind with first and second transverse threads of the two woven fabric layers.

The disadvantage of this paper machine band is the same as of the band disclosed in WO 2006/020414 A1. The second longitudinal threads must absorb large part of the tensile forces acting upon the woven fabric band, and these second longitudinal threads are subject to abrasion over their lifetime, due to floating segments projection on the machine side of the band.

The object which forms the basis of the invention is to design a woven fabric band, in particular for use in a paper machine, such that the greatest possible freedom is obtained when forming the outer sides and so flexibility in adaptation to the respective application is obtained, and at the same time a high degree of tensile strength and high abrasion resistance is achieved here.

In order to achieve this object one starts according to the invention with a woven fabric band which is formed from two woven fabric layers, and with which, consequently, the freedom of form on both outer sides—with a paper machine woven fabric band the paper side on the one hand and the machine side on the other hand—is very great in comparison to single-layer woven fabric bands, and so both outer sides can be optimally adapted to the respective requirements. In order at the same time to be able to achieve a high level of rigidity and high abrasion resistance here, according to the invention the second longitudinal threads form a first longitudinal thread group with outer second longitudinal threads and a second longitudinal thread group with inner second longitudinal threads, the outer second longitudinal threads defining the outer side of the second woven fabric layer and the inner second longitudinal threads extending totally within the woven fabric band. Therefore, according to the invention (at least) three longitudinal thread groups are formed, the first and the second longitudinal thread group with the second transverse threads forming the second woven fabric layer, and the third longitudinal thread group serving to form the first woven fabric layer. Therefore, all three longitudinal thread groups can be adapted optimally to their respective function, both with regard to their binding into the woven fabric band and the woven fabric layers assigned to them and with regard to their material.

SUMMARY OF THE INVENTION

The division according to the invention of the second longitudinal threads into outer and inner longitudinal threads enables a functional separation in the sense that by being guided principally on the outer side of the second woven fabric layer the outer second longitudinal threads can essentially serve to provide a high volume of abrasion, whereas the inner second longitudinal threads essentially determine the tensile strength of the woven fabric band and are thus protected from contact with machine elements and so from abrasion by being bound within the woven fabric band and by the guiding of the outer second longitudinal threads. Therefore, the wear arising due to the circulation of the woven fabric band with the outer second longitudinal threads has less of an effect upon the overall tensile strength of the woven fabric band because the tensile forces are largely absorbed by the inner second longitudinal threads. Consequently, the tensile strength of the woven fabric band is largely maintained due to the protected extension over the operating time of the woven fabric band.

The material of the inner and outer second longitudinal threads can be equal in abrasion resistance. In a particularly advantageous embodiment of the invention the abrasion resistance of the material of which the outer second longitudinal threads are made should be greater than that of the material of which the inner second longitudinal threads are made. Polyamide materials, for example, have particularly high abrasion resistance. The use of copolymers, as known for example from U.S. Pat. No. 5,169,711, is also very advantageous. Here monofilaments are disclosed which comprise a mixture of 60 to 90% by weight polyethylene terephthalate polyester (PET polyester) and 40 to 10% by weight thermoplastic polyurethane (PU) and a hydrolysis stabiliser and are characterised by high abrasion resistance. Reference is made explicitly to the overall content of the aforementioned document for the purpose of incorporating the content of the latter into the present description. In addition to this, it is also possible to use other abrasion-resistant materials such as polyester or polypropylene.

Furthermore, the basic idea behind the invention opens up the possibility of using for the inner second longitudinal threads a material the tensile strength of which is greater than that of the material from which the outer second longitudinal threads are made. Particularly advantageous here are the materials PET and/or polyethylene naphthalate (PEN) or copolymers, using at least one of these materials. It goes without saying that it is advantageous to combine both of the aforementioned measures with one another, i.e. to optimise the outer second longitudinal threads as regards their abrasion resistance with respect to the inner second longitudinal threads and to highlight the tensile strength of the inner second longitudinal threads with respect to the outer second longitudinal threads.

For the first longitudinal threads the materials generally used for this can be considered, preferably—as with the inner second longitudinal threads—PET, PEN or copolymers using at least one of these two materials. In this way the first longitudinal threads also have a high degree of tensile strength. Since in particular when using the woven fabric band in the paper machine they are not subjected to any abrasion, their contribution to the tensile strength of the woven fabric band as a whole remains largely unchanged over the operating time.

The material for the transverse threads can be used for the respective intended purpose of the woven fabric band. Advantageously, the materials PET, polyamide (PA), polybutylene terephthalate (PBT), PTT, polyphenylene sulphide (PPS) or copolymers can be considered, using at least one of the aforementioned materials.

The binding of the second longitudinal threads should in principle be implemented such that floats are produced over a number of second transverse threads and the second transverse threads are respectively only briefly bound, i.e. the inner second longitudinal threads bind two second transverse threads on the lower side at one binding point, preferably however just a single second transverse thread, and such that the outer second longitudinal threads bind at best two second transverse threads at one binding point, but preferably just a single second transverse thread. The floats should advantageously pass over at least three second transverse threads.

It is basically possible for the outer and/or inner second longitudinal threads within a transverse thread repeat to bind just once with one or two second transverse threads in order to obtain long floats. Alternatively, the longitudinal thread extensions within one transverse thread repeat can also be designed, however, such that the inner second longitudinal threads or the outer second longitudinal threads or both float alternately over a number X of second transverse threads and then over at least a number X+1 second transverse threads. As a minimum for X the number 3, and better still 4 second transverse threads is advantageous in order to obtain sufficiently long floats and so on the one hand to make available a high abrasion volume and on the other hand to guarantee good protection of the inner second longitudinal threads.

In a further embodiment of the invention provision is made such that the second woven fabric layer has pairs of longitudinal threads from two adjacent second longitudinal threads, respectively comprising an inner and an outer second longitudinal thread, and that the pairs of longitudinal threads bind second transverse threads together. In this way, where the transverse threads are bound together by the pairs of longitudinal threads, they are bound on the outside and on the inside and so are anchored particularly stablely in the woven fabric by interlocking. This can, but does not have to happen at each binding point of the second longitudinal threads. It is sufficient if common binding of the trans-verse threads only takes place at every other binding point of one of the two second longitudinal threads forming a pair of longitudinal threads.

The second woven fabric layer can only be formed from the aforementioned pairs of longitudinal threads. It is possible, however, to dispose between the pairs of longitudinal threads at least one further outer second longitudinal thread respectively which preferably, offset in relation to the outer second longitudinal threads of the adjacent pair of longitudinal threads binds with the second transverse threads. This can especially happen in such a way that the further outer second longitudinal threads bind with second transverse threads which are bound by an inner second longitudinal thread of an adjacent pair of longitudinal threads so that in this respect too common binding of a transverse thread is implemented binding the outer and the inner side. The further second longitudinal threads can have a long floating extension by them binding just once with second trans-verse threads within a transverse thread repeat.

The ratio of the numbers between the outer and the inner second longitudinal threads can be adapted relatively freely to the respective requirements. If due to its intended use the woven fabric band is only subjected to a relatively small amount of abrasion, the number of inner second longitudinal threads can predominate with respect to that of the outer second longitudinal threads because only a small abrasion volume needs to be made available. For use in the paper machine and here in particular in the forming section where the paper machine bands pass via fixed machine parts such as suction boxes or similar, the ratio between the inner and the outer second longitudinal threads should be at least 1:1, better 1:2 or 1:3 in order to make available a large abrasion volume.

The ratio between the first and the second longitudinal threads should generally be 1:1. Depending on the intended use this ratio can also be formed differently, and can be from 1:3 to 3:1, ratios extending beyond this also being possible if this can be considered to be advantageous.

The total number of longitudinal threads per cm can also be adapted within broad limits to the conditions for use of the woven fabric band. For example, the number can range from 48 to 84 longitudinal threads/cm, it being possible to choose the distribution over the first and the second longitudinal threads and with the latter over the inner and the outer longitudinal threads according to the aforementioned ratios.

According to a further feature of the invention, provision is made such that the inner second longitudinal threads bind at least twice as frequently with the second transverse threads as the outer second longitudinal threads. In this way, on the one hand long floats can be produced with the outer second longitudinal threads providing a large abrasion volume, and on the other hand good binding of the second transverse threads with spacing from the abrasion plane formed by the outer side of the lower woven fabric layer and so good protection both of the second transverse threads and of the inner second longitudinal threads is guaranteed. Here the inner and the outer longitudinal threads can respectively be grouped to form a pair of longitudinal threads of the type described above such that the second longitudinal threads of each pair of longitudinal threads bind together the second transverse threads at every other binding point.

Alternatively, the inner second longitudinal threads can be bound into the second woven fabric layer in a mirror image of the outer second longitudinal threads, and advantageously such that pairs of longitudinal threads of the type described above are formed so that the second transverse threads are bound together respectively at all binding points. It goes without saying that both types of binding of the second longitudinal threads can also be combined together with the transverse threads. A mirror-image extension in the sense described above is also provided if the inner second longitudinal threads occasionally bind into the first woven fabric layer in order to join both woven fabric layers to one another.

As already mentioned, the woven fabric structure according to the invention allows a great deal of freedom for adapting the outer side of the first woven fabric layer to the respective requirements. If the woven fabric band is used in the paper machine, especially as a forming fabric, it is recommended that the first longitudinal and the first transverse threads form a plain weave because this type of weave forms a particularly large number of support points for the paper fibres and the fabric of paper being formed, and so the risk of marks remaining in the band of paper is minimized.

Furthermore, according to the invention provision is made such that the cross-sectional area of the first longitudinal threads is smaller than the cross-sectional area of the outer and/or the inner second longitudinal threads. The idea forming the basis of this is to use finer longitudinal threads for the first woven fabric layer than for the second woven fabric layer. If circular longitudinal threads are used in the cross-section, the diameter of the first longitudinal threads should range from 0.05 mm to 0.6 mm and that of the second longitudinal threads from 0.1 mm to 0.6 mm. Here the diameter of the inner and the outer second longitudinal threads can be the same. Alternatively, depending on the ratio between the inner and the outer second longitudinal threads, the diameters can also be different, for example 0.1 and 0.2, 0.2 and 0.3, or 0.2 and 0.4.

In accordance with the different functions of the first and the second transverse threads the diameters of the latter—in so far as they have a circular cross-section—must not be the same. In order to obtain a particularly fine surface of the first woven fabric layer, the first transverse threads—advantageously in combination with fine first longitudinal threads—should have a smaller diameter than the second transverse threads. For example, the first transverse threads can have a diameter of 0.08 mm to 0.4 mm, and the second transverse threads a diameter of 0.12 to 0.6 mm. As regards the first trans-verse threads, it is advantageous that the diameter of the latter is identical with to the diameter of the first longitudinal threads.

For the second longitudinal threads, a square cross section can be used for the outer second longitudinal threads. So-called flat threads are particularly suitable. These flat threads have a cross-section the extension of which in the transverse direction of the woven fabric band—i.e. at right angles to the designated running direction—is greater than in the thickness direction of the latter, i.e. perpendicularly to the plane of the woven fabric band. These longitudinal threads can, for example, have an oval cross-section, but are advantageously rectangular in form, for example with a side ratio of 1.1:1, 1.2:1, 1.3:1 etc. up to 4:1. The preferred cross-sections are 0.12 mm:0.19 mm, 0.25 mm:0.3 mm, 0.25 mm:0.33 mm, 0.3 mm:0.45 mm, 0.3 mm:0.6 mm.

The two woven fabric layers can be joined to one another in different ways. In the prior art it is known to join together two separate woven fabric layers by means of special binding threads which extend outside of the repeat pattern. Instead of this, it is possible to join the two woven fabric layers by means of intrinsic threads, i.e. threads belonging to the repeat pattern, the longitudinal threads otherwise assigned to a woven fabric layer occasionally binding with transverse threads of the other woven fabric layer. This can happen in such a way that inner second longitudinal threads are bound by first transverse threads and/or first longitudinal threads bind with second transverse threads or also in combination both longitudinal threads.

BRIEF DESCRIPTION OF THE INVENTION

Figure 2:
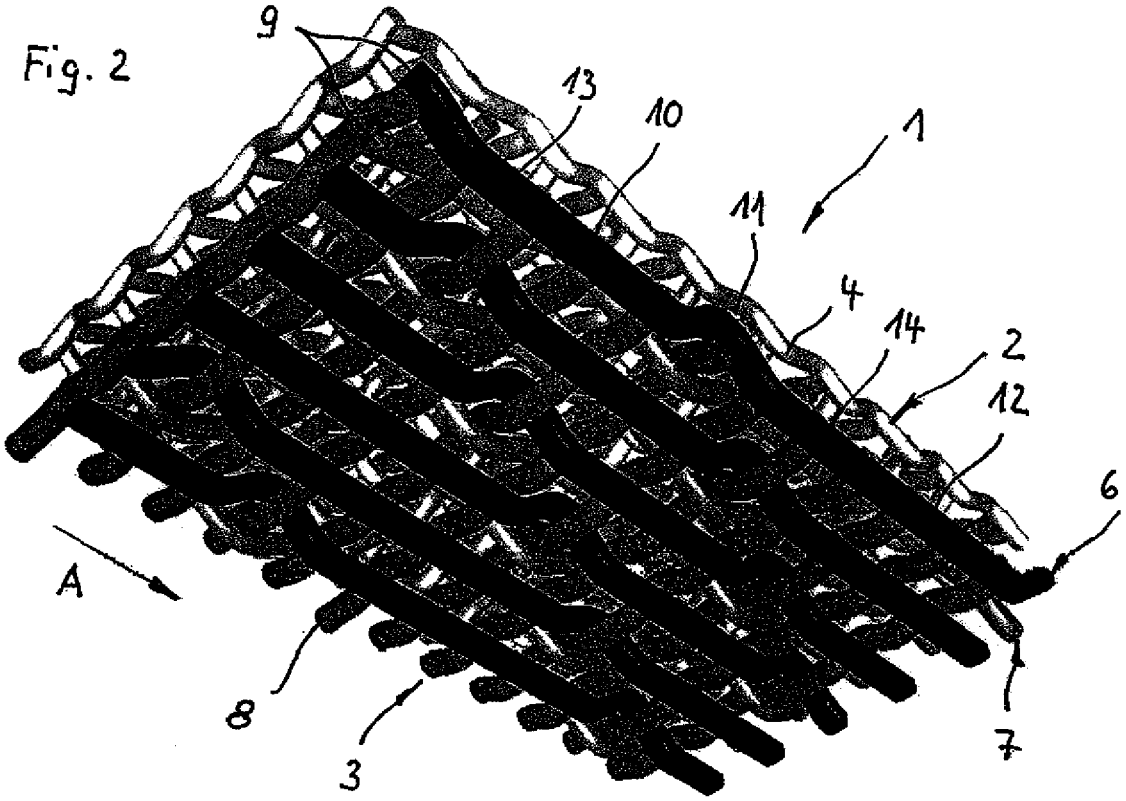
Figure 3:
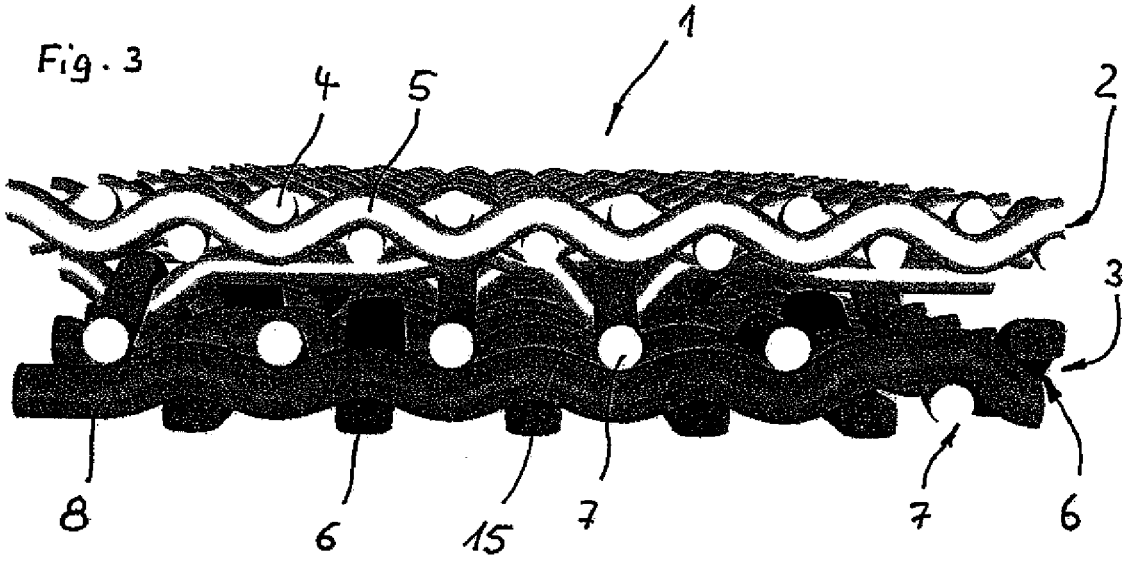
Figure 4:
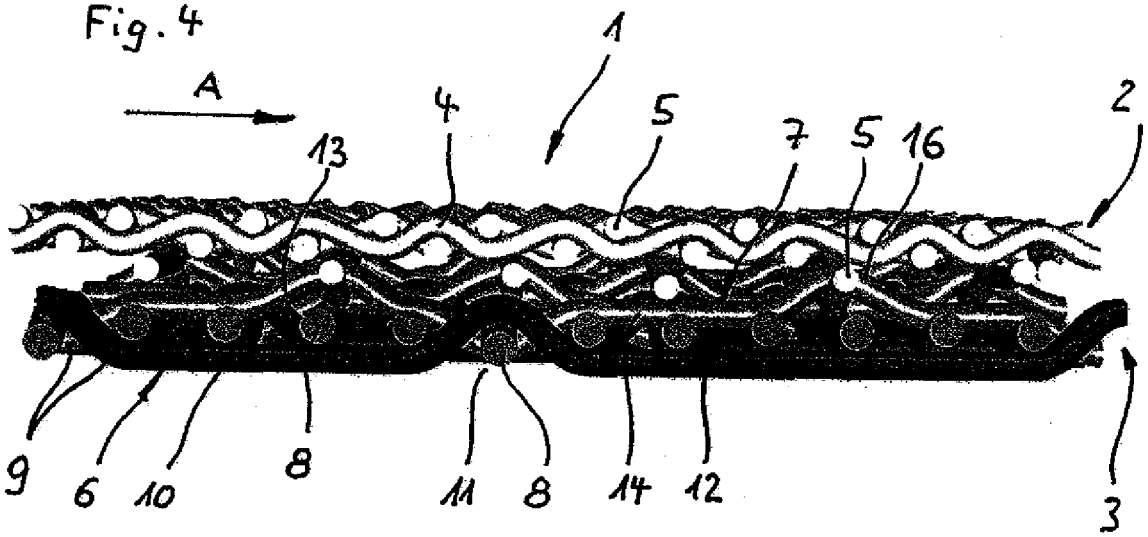
Figure 5:
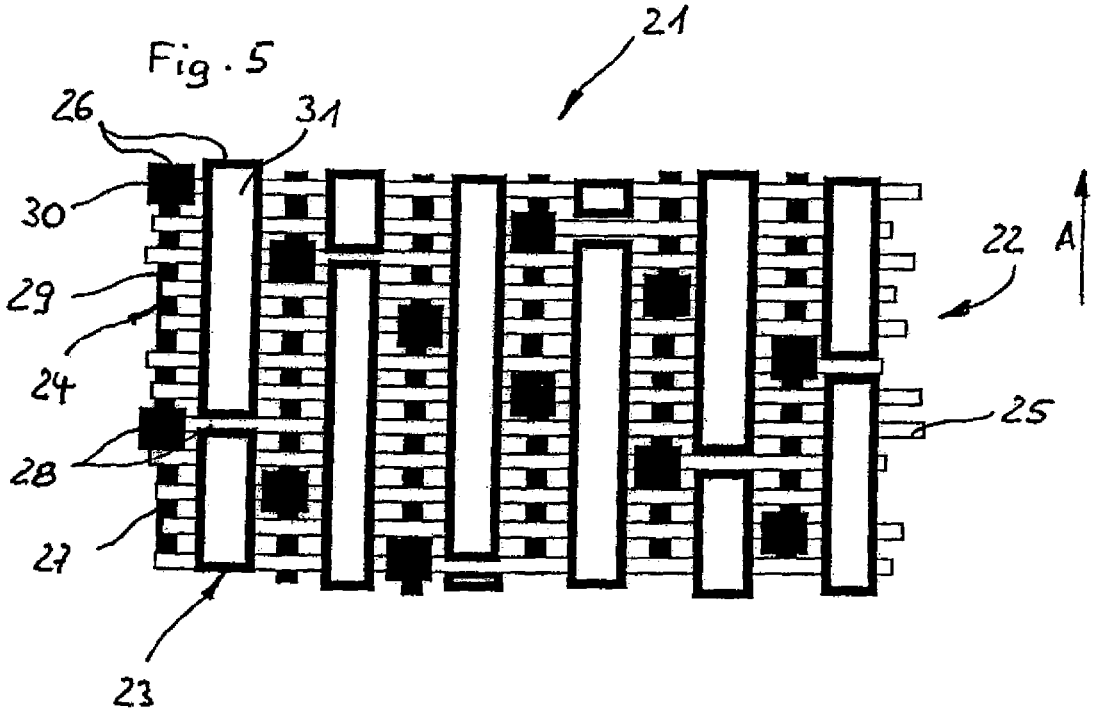
Figure 6:
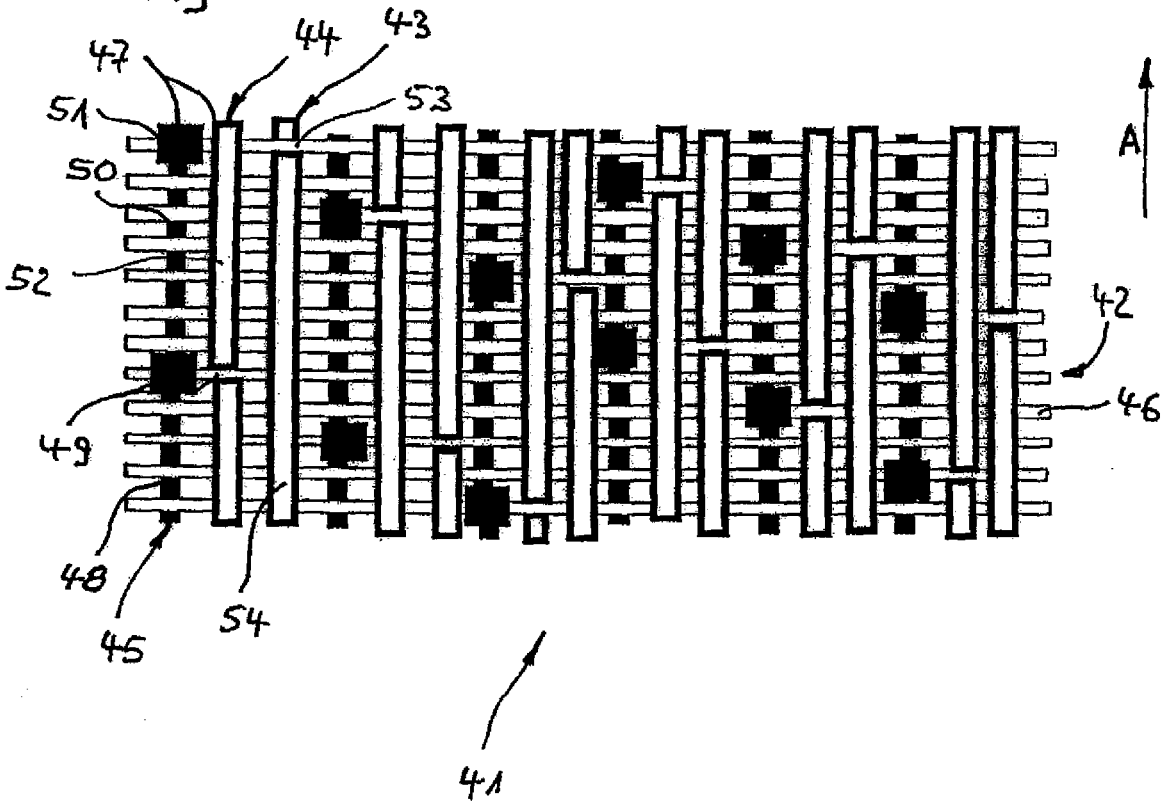
Figure 7:
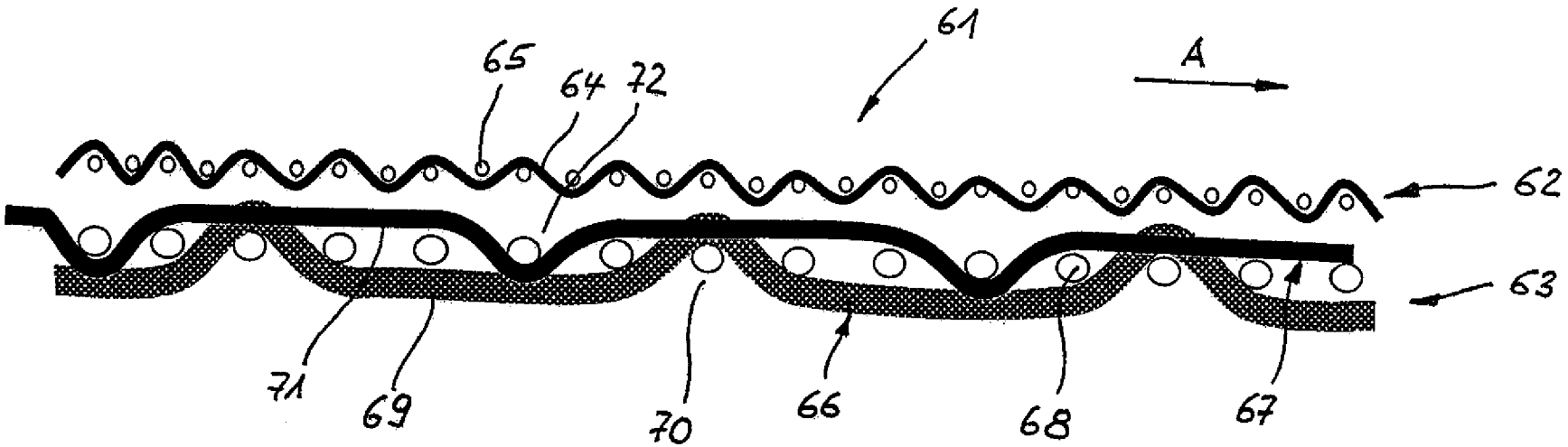

In the drawings the invention is illustrated in greater detail by means of exemplary embodiments. These show as follows:

FIG. 1 a perspective view of a portion of the paper side of a forming fabric according to the invention within the area of a binding repeat;

FIG. 2 a perspective view of the machine side of the portion of the forming fabric according to FIG. 1;

FIG. 3 a cross-section through the portion of the forming fabric according to FIGS. 1 and 2;

FIG. 4 a longitudinal section through the portion of the forming fabric according to FIGS. 1 to 3;

FIG. 5 a diagrammatic illustration of the machine side of a portion of a second forming fabric according to the invention within the area of a binding repeat;

FIG. 6 a diagrammatic illustration of the machine side of a portion of a third forming fabric according to the invention within the area of a binding repeat, and FIG. 7 a longitudinal section through a portion of a forth forming fabric according to the invention.

DETAILED DESCRIPTION OF THE PREFERRED EMBODIMENT(S)

The forming fabric 1 illustrated in FIGS. 1 to 4 has a first, paper side woven fabric layer 2 and a second, machine side woven fabric layer 3. Both woven fabric layers 2, 3 are layered one over the other.

The first woven fabric layer 2 comprises first longitudinal threads extending in running direction A—for example identified by 4 and light grey in colour—and first transverse threads extending at right angles to the latter—for example identified by 5 and also light grey in colour—, which both have a circular cross-section. The first longitudinal and the first transverse threads 4, 5 are interwoven with one another to form a plain weave, i.e. the first longitudinal threads 4 respectively bind alternately a first transverse thread 5 on the outer or paper side and the subsequent first transverse thread 5 on the inner side.

The second woven fabric layer 3 is formed by outer second longitudinal threads extending in running direction A —identified for example by 6 and black in colour—and inner second longitudinal threads—identified for example by 7 and dark grey in colour—and by second transverse threads—identified for example by 8 and also dark grey in colour. It can be seen that the inner second longitudinal threads 7 have a circular cross-section with a larger diameter than the first longitudinal threads 4 and that the second transverse threads 8 also have a larger diameter than the first transverse threads 5. The outer second longitudinal threads 6 have a rectangular, flattened cross-section, the cross-sectional extension of the latter at right angles to the running direction A being greater than the height of the latter, i.e. of the cross-sectional extension of the latter perpendicular to the plane of the forming fabric 1 (see in particular FIG. 3). As can be seen in particular from the longitudinal section according to FIG. 4, the ratio of the numbers of threads between the first and the second transverse threads 5, 8 is 2:1. The ratio of the numbers of threads of the first and the second longitudinal threads 4, 6, 7 is 1:1, as can be seen in particular in FIG. 3.

The outer and the inner second longitudinal threads 6, 7 alternate according to the ratio 1:1. In this way pairs of longitudinal threads respectively comprising an outer and an adjacent inner longitudinal thread 6, 7 are produced—identified for example by 9—, which—apart from one exception still to be explained—bind in a mirror image with the second transverse threads 8 such as to form a longitudinal thread repeat of 12 second longitudinal threads 6, 7 and a transverse thread repeat of 12 second transverse threads 8.

Here—as shown in particular by FIG. 4—the second longitudinal threads 6, 7 of a pair of longitudinal threads 9 extend such that the respective outer second longitudinal thread 6 forms on the outside, i.e. on the machine side, a first float—identified for example by 10—over four second transverse threads 8, then binds a second transverse thread 8 on the inside at a binding point 11, and then extends with a second float 12 over six consecutive second transverse threads 8, while the inner second longitudinal thread 7 also forms a float 13 passing over four second transverse threads 8 on the inside above the float 10, then binds the second transverse thread 8 on the outside at the binding point 11 and then—like the outer second longitudinal thread 6—extends with a second float 14 above the float 12 over six second transverse threads 8, but over the inner sides of the latter. In this way the second transverse threads 8 are bound at all of the binding points 11 by the second longitudinal threads 6, 7 of a pair of longitudinal threads 9 on the inside and the outside forming an interlocking. From the perspective illustration according to FIG. 2 it can be seen that the binding points 11 of adjacent pairs of longitudinal threads 9 are displaced respectively by two second transverse threads 8 in running direction A.

Due to the only occasional binding of the second transverse threads 8 at distances of alternately four or six second transverse threads 8 an outer side of the second woven fabric layer 3 or machine side of the forming fabric 1 formed only by the outer second longitudinal threads 6 and an extension of the inner second longitudinal threads 7 extending only in the inside of the forming fabric 1 are produced, the outer second longitudinal threads 6 providing a large abrasion volume. Of course, it is possible to displace the binding points 11 about one second transverse thread 8 in running direction A, so that the floats between two binding points would be the same, i.e. passing over five second transverse threads 8 respectively.

As can be seen in particular from FIGS. 3 and 4, the two woven fabric layers 2, 3 are joined to one another in that the inner second longitudinal threads 7—and this is the exception to the symmetrical mirror image extension of the two second longitudinal threads 6, 7 of a pair of longitudinal threads 9 mentioned above—occasionally are bound by transverse threads 5 with knuckles—identified for example by 15 and 16—(see FIGS. 3 and 4), twice in each transverse thread repeat. The joining of the two woven fabric layers 2, 3 therefore happens by means of intrinsic threads forming the woven fabric repeat, i.e. in this case no special binding threads are provided.

FIG. 5 shows, as a section, the lower side (machine side) of a second forming fabric 21, only the second woven fabric layer 22 of the latter being illustrated diagrammatically. The woven fabric layer 22 is formed by outer second longitudinal threads extending in running direction A—identified for example by 23 and shown as rectangles with a black outline—and inner second longitudinal threads—identified for example by 24 and black in colour—and by second transverse threads—identified for example by 25. The outer and the inner second longitudinal threads 23, 24 alternate according to the ratio 1:1. In this way pairs of longitudinal threads—identified for example by 26—here also comprising respectively an outer and an inner longitudinal thread 23, 24 are produced, which however do not bind in a mirror image with this exemplary embodiment.

The inner second longitudinal threads 24 have the same extension as the inner second longitudinal threads 7 with the forming fabric 1 according to FIGS. 1 to 4, i.e. within a transverse thread repeat they have a first float 27 passing on the inside over four second transverse threads 25, then bind at a first binding point 28—like all of the binding points of the inner second longitudinal threads 24 highlighted as a black square—on the outside a second transverse thread 25 and then on the inside form a second float 29 passing over six second transverse threads 25 before they then bind a second transverse thread 25 on the outside at a further binding point 30. The outer second longitudinal thread 23 of the pair of longitudinal threads 26 disposed next to the latter binds just once with a second transverse thread 25 in the transverse thread repeat, namely at the first binding point 28 of the inner second longitudinal thread 24. Therefore, the second transverse thread 25 is bound here on the inside and on the outside.

In this way the outer second longitudinal thread 23 forms long floats respectively passing over eleven second transverse threads 25—identified for example by 31—, i.e. within a transverse thread repeat the inner second longitudinal threads 24 bind twice as often with the second transverse threads 25 as the outer second longitudinal threads 23. Here the pairs of longitudinal threads 26 are offset in relation to one another in running direction A within a longitudinal thread repeat such that all of the second transverse threads 25 are bound.

FIG. 6 also shows the lower side (machine side) of a third forming fabric 41, here too only the second woven fabric layer 42 of the latter being shown and the first woven fabric layer being left out. The woven fabric layer 42 is formed by outer second longitudinal threads extending in running direction A—identified for example by 43 and 44 and shown as rectangles outlined in black—and inner second longitudinal threads—identified for example by 45 and black in colour—and by second transverse threads—identified for example by 46. The outer and the inner second longitudinal threads 43, 44, 45 alternate according to the ratio 2:1. Here pairs of longitudinal threads respectively comprising two adjacent outer and inner longitudinal threads 44, 45—identified for example by 47—are formed between which a further second longitudinal thread 43 respectively extends. In this way a transverse thread repeat of 12 second transverse threads 46 and a longitudinal thread repeat of 18 second longitudinal threads 43, 44, 45 is produced.

The inner second longitudinal threads 45 have the same extension as the inner second longitudinal threads 7 with the forming fabric 1 according to FIGS. 1 to 4 and as the inner second longitudinal threads 24 with the forming fabric 21 according to FIG. 5, i.e. within the transverse thread repeat they have a first float 48 passing on the inside over four second trans-verse threads 46, bind at a first binding point 49—highlighted like all of the binding points of the inner second longitudinal threads 45 as a black square—on the outside a second transverse thread 46 and then form on the inside a second float 50 passing over six second transverse threads 46 before they then bind at a further binding point 51 a second transverse thread 46 on the outside. The outer second longitudinal thread 44 of the pair of longitudinal threads 47 disposed next to the latter binds—as with the forming fabric 21 according to FIG. 5—just once in the transverse thread repeat with a second transverse thread 46 such as to form a float 52 passing over eleven second transverse threads 46, namely here too at the first binding point 49 of the inner second longitudinal thread 45. Here the second transverse thread 46 is bound on the inside and on the outside. Consequently, the pairs of longitudinal threads 47 bind in precisely the same way as the pairs of longitudinal threads 26 with the forming fabric 21 according to FIG. 5.

The additional outer second longitudinal threads 43 also only bind once within a transverse thread repeat with a second transverse thread 46 at binding points—identified for example by 53—, and so have—as do the other outer second longitudinal threads 44—a float 54 passing over eleven second transverse threads 46 on the outside. However, the binding points 53—as can be seen from FIG. 6—are offset by a number of second transverse threads 46 in running direction A in relation to those of the respective adjacent outer second longitudinal thread 44.

Due to the larger number of outer second longitudinal threads 43, 44 in relation to the embodiments according to FIGS. 1 to 5, with the forming fabric 41 a larger abrasion volume is made available, and so this forming fabric 41 is particular suitable for those applications where the forming fabric 41 is subjected to a high degree of abrasion.

FIG. 7 illustrates a fourth embodiment of a forming fabric 61 having a first, paper side woven fabric layer 62 and a second, machine side woven fabric layer 63. Both woven fabric layers 62, 63 are layered one over the other, and are connected by transverse threads, which is not illustrated.

The first woven fabric layer 62 comprises first longitudinal threads 64 extending in running direction A and first transverse threads—for example identified by 65—extending at right angles to the latter, which both have a circular cross-section. The first longitudinal and the first transverse threads 64, 65 are interwoven with one another to form a plain weave, i.e. the first longitudinal threads 64 respectively bind alternatively a first transverse thread 65 on the outer or paper side and the subsequent first transverse thread 5 on the inner side.

The second woven fabric layer 63 is formed by outer second longitudinal threads 66 extending in running direction A and inner second longitudinal threads 67 and by second transverse threads—identified for example by 68.

In FIG. 7 only a pair of two adjacent inner and outer second longitudinal threads 66, 67 are illustrated. The outer second longitudinal threads 66 forms on the outside, i.e. on the machine side, floats—identified for example by 69—over four second transverse threads 68, than binds a second transverse thread 68 on the inside at a binding point 70, and than extends with another float 69. The inner second longitudinal thread 67 also forms a float—identified for example by 71—passing over four second transverse threads 68 on the inside, than binds a second transverse thread 68 on the outside at a binding point 72 and continue with another float 71 about four further second transverse threads 68. The binding points 70, 72 are displaced by three second transverse threads 68 in running direction A, so that there is no interlocking, i.e. at the binding points 70, 72, only one of the pair of second longitudinal threads 66, 67 binds a second transverse thread 68.

We claim:

1. A woven fabric band (1, 21, 41, 61) for circulation in a machine, in particular a paper machine woven fabric band, having a first woven fabric layer (2, 62) comprising first longitudinal and first transverse threads (4, 5, 64, 65) interwoven with one another and having a second woven fabric layer (3, 22, 42, 63) comprising second longitudinal and second transverse threads (6, 7, 8, 23, 24, 25, 43, 44, 45, 46, 66, 67, 68) interwoven with one another, the outer side of the second woven fabric layer (3, 22, 42, 63) being formed by floats (10, 12, 13, 14, 27, 29, 31, 48, 50, 52, 54, 69, 71) of second longitudinal threads (6, 7, 23, 24, 43, 44, 45, 66, 67), characterized in that the second longitudinal threads (6, 7, 23, 23, 43, 44, 45, 66, 67) form a first longitudinal thread group with outer second longitudinal threads (6, 23, 43, 44, 66) and a second longitudinal thread group with inner second longitudinal threads (7, 24, 45, 67) and that the outer second longitudinal threads (6, 23, 43, 44, 66) form the outer side of the second woven fabric layer (3, 22, 42, 63) and the inner second longitudinal threads (7, 24, 45, 67) extend totally within the woven fabric band (1, 21, 41, 61).

2. The woven fabric band according to claim 1, characterized in that the abrasion resistance of the material from which the outer second longitudinal threads (6, 23, 43, 44, 66) are made is greater than that of the material from which the inner second longitudinal threads (7, 24, 45, 67) are made, and/or the tensile strength of the material from which the inner second longitudinal threads (7, 24, 45, 67) are made is greater than that of the material from which the outer second longitudinal threads (6, 23, 43, 44, 66) are made.

3. The woven fabric band according to claim 1, characterized in that the outer second longitudinal threads (6, 23, 43, 44, 66) respectively bind just one second transverse thread (8, 25, 46, 68) on the inside and/or the inner second longitudinal threads (7, 24, 45, 67) respectively bind just one second transverse thread (8, 25, 46, 68) on the outside.

4. The woven fabric band according to claim 1, characterized in that the inner second longitudinal threads (7, 24, 45, 67) and/or the outer second longitudinal threads (6, 23, 43, 44, 66) respectively float over at least three second transverse threads (8, 25, 46, 68).

5. The woven fabric band according to claim 1, characterized in that the inner and/or the outer second longitudinal threads (6, 7, 23, 24, 43, 44, 45) alternately float over a number X of second transverse threads (8, 25, 46) and then over at least a number X+1 of second transverse threads (8, 25, 46).

6. The woven fabric band according to claim 1, characterized in that the second woven fabric layer (3, 22, 42, 63) has pairs of longitudinal threads (9, 26, 47) from two adjacent second longitudinal threads (6, 7, 23, 24, 44, 45, 66, 67) respectively comprising an inner and an outer second longitudinal thread (6, 7, 23, 24, 44, 45, 66, 67) and that the pairs of longitudinal threads (9, 26, 47) bind second transverse threads (8, 25, 46) together.

7. The woven fabric band according to claim 6, characterized in that between the pairs of longitudinal threads (47) there extends respectively at least one further outer second longitudinal thread (43).

8. The woven fabric band according to claim 7, characterized in that the further outer second longitudinal threads (43) bind with second transverse threads (46) which are bound by an inner second longitudinal thread (45) of an adjacent pair of longitudinal threads (47).

9. The woven fabric band according to claim 1, characterized in that the number of the outer second longitudinal threads (6, 23, 43, 44, 66) is at least as great as the number of the inner second longitudinal threads (7, 24, 45, 67).

10. The woven fabric band according to claim 1, characterized in that the inner second longitudinal threads (24, 45) bind with the second transverse threads (25, 46) at least twice as frequently as the outer second longitudinal threads (23, 43, 44).

11. The woven fabric band according to claim 1, characterized in that the inner second longitudinal threads (7) are bound into the second woven fabric layer (3) in a mirror image to the outer second longitudinal threads (7).

12. The woven fabric band according to claim 1, characterized in that the first longitudinal and the first transverse threads (4, 5, 64, 65) form a plain weave.

13. The woven fabric band according to claim 1, characterized in that the cross-sectional area of the first longitudinal threads (4, 64) is smaller than the cross-sectional area of the outer and/or the inner second longitudinal threads (6, 7, 23, 24, 43, 44, 45, 66, 67).

14. The woven fabric band according to claim 1, characterized in that the outer second longitudinal threads (6, 23, 43, 44, 66) have a cross-section the extension of which in the transverse direction of the woven fabric band (1, 21, 41, 61) is greater than in the thickness direction of the latter.

15. The woven fabric band according to claim 1, characterized in that the woven fabric layers (2, 3) are joined in that inner second longitudinal threads also bind with first transverse threads (5) and/or that second transverse threads also bind with first longitudinal threads and/or that first longitudinal threads bind with second transverse threads and/or that first transverse threads (5) also bind with inner second longitudinal threads (7) and/or that the two woven fabric layers are joined by separate binding threads.

16. The woven fabric band according to claims 2, characterized in that the inner second longitudinal threads (7, 24, 45, 67) and/or the outer second longitudinal threads (6, 23, 43, 44, 66) respectively float over at least three second transverse threads (8, 25, 46, 68).

17. The woven fabric band according to claim 3, characterized in that the inner second longitudinal threads (7, 24, 45, 67) and/or the outer second longitudinal threads (6, 23, 43, 44, 66) respectively float over at least three second transverse threads (8, 25, 46, 68).

18. The woven fabric band according to claim 2, characterized in that the inner and/or the outer second longitudinal threads (6, 7, 23, 24, 43, 44, 45) alternately float over a number X of second transverse threads (8, 25, 46) and then over at least a number X+1 of second transverse threads (8, 25, 46).

19. The woven fabric band according to claim 3, characterized in that the inner and/or the outer second longitudinal threads (6, 7, 23, 24, 43, 44, 45) alternately float over a number X of second transverse threads (8, 25, 46) and then over at least a number X+1 of second transverse threads (8, 25, 46).

20. The woven fabric band according to claim 4, characterized in that the inner and/or the outer second longitudinal threads (6, 7, 23, 24, 43, 44, 45) alternately float over a number X of second transverse threads (8, 25, 46) and then over at least a number X+1 of second transverse threads (8, 25, 46).

* * * * *